United States Patent [19]

Takakuwa

[11] 4,290,886

[45] Sep. 22, 1981

[54] FLOTATOR

[75] Inventor: Takeshi Takakuwa, Sapporo, Japan

[73] Assignee: Nagata Seisakusho Co., Ltd., Japan

[21] Appl. No.: 126,157

[22] Filed: Feb. 29, 1980

[30] Foreign Application Priority Data

Mar. 3, 1979 [JP] Japan ..... 54-24046

[51] Int. Cl.[3] ..... B03D 1/00

[52] U.S. Cl. ..... 210/219; 209/169; 210/221.2; 261/121 R

[58] Field of Search ..... 209/168, 169; 210/44, 210/219, 221 R, 221 M; 261/87, 121 R

[56] References Cited

U.S. PATENT DOCUMENTS

| | | | |
|---|---|---|---|
| 1,242,445 | 10/1917 | Ittner | 209/169 X |
| 1,283,159 | 10/1918 | Groch | 209/169 X |
| 1,312,976 | 8/1919 | Groch | 209/169 X |
| 1,417,895 | 5/1922 | Fahrenwald | 209/169 X |
| 2,189,779 | 2/1940 | Daman | 209/168 |
| 2,313,654 | 3/1943 | MacLean | 209/169 X |
| 2,433,592 | 12/1947 | Booth | 209/168 X |
| 2,996,287 | 8/1961 | Audran | 261/87 X |
| 3,420,370 | 1/1969 | Isenhardt et al. | 209/169 |
| 3,972,815 | 8/1976 | O'Cheskey et al. | 210/219 |
| 4,193,949 | 3/1980 | Naito | 261/87 |

FOREIGN PATENT DOCUMENTS

| | | | |
|---|---|---|---|
| 2559236 | 7/1977 | Fed. Rep. of Germany | 210/219 |
| 2281323 | 3/1976 | France | 210/219 |

*Primary Examiner*—Robert H. Spitzer

*Attorney, Agent, or Firm*—Pollock, Vande Sande & Priddy

[57] ABSTRACT

A flotator for use in benefication, coal dressing, wet refining and so forth, incorporating a surface flotation technic. The flotator has a funnel-shaped liquid cell having a bottom of an area smaller than that of the top opening. A bubbling device is constituted by an upper sleeve partly immersed in the liquid contained by the cell, a lower sleeve disposed coaxially with the upper sleeve and fully immersed in the liquid. The upper end of the lower sleeve is spaced by a predetermined distance from the lower end of the upper sleeve to form therebetween a spaced region located at a small depth from the liquid surface. The bubbling device further has a rotary blade unit constituted by upper and lower blades separated by a flat partition plate. The rotary blade unit is adapted to rotate around the common axis of the upper and lower sleeves, and has a thickness or axial height substantially equal to the aforementioned predetermined distance in the spaced region, and is located such that the flat partition plate is located at the heightwise mid point of the spaced region. The flotator further has a liquid surface stabilizer constituted by a frusto-conical member disposed around the bubbling device and adapted to deflect the liquid downwardly. Further, provided are a feeding passage having a feed gate opening in the bottom area of the cell and a discharging passage having a discharge gate spaced from both of the feed gate and the lower edge of the liquid surface stabilizer so as to avoid the "short-circuiting" of the liquid.

9 Claims, 6 Drawing Figures

FLOTATOR

BACKGROUND OF THE INVENTION

The present invention relates to a construction of a flotator incorporating a novel surface flotation technic adapted for use in benefication, coal dressing, wet refining, fuel solution treatment and so forth.

Hitherto, there have been proposed various types of flotators among which the WEMCO 1+1 type flotator and the DENVER D-R type flotators are well known.

However, as will be fully described later with reference to the drawings, these known flotators have suffer from various drawbacks or disadvantages. More specifically, in the WEMCO 1+1 type flotator, the settled particles are inconveniently scattered in the liquid because of the presence of a large free space in the cell. Another drawback is a phenomenon referred to as "short-circuiting" in which a part of the solution to be treated is directly conveyed to the discharge side of the flotator without being subjected to flotation.

Referring now to the DENVER D-R type flotator, the flotation power is limited due to its specific construction, as will be explained later. In addition, the unfavorable "short-circuiting" is also observed in this type of flotator. Further, this type of flotator necessitates a blower for supplying air.

SUMMARY OF THE INVENTION

It is, therefore, a major object of the invention to provide a flotator incorporating a novel surface flotation technic, in which "short-circuiting" of the solution is avoided to afford a high precision of sorting and in which a large flotation capacity is ensured with a reduced power and decreased volume and installation area, thereby overcoming the above-described problems confronting the prior art.

To this end, according to the invention, a rotary blade unit having upper and lower blades and provided with a partition plate is coaxially disposed between upper and lower aligned sleeves at a small depth from the liquid surface. This rotary blade unit is intended for both bubbling and flowing of the liquid. A feed gate and a discharge gate are spaced a considerably large distance from each other, thereby obviating the undesirable short-circuiting of the liquid. Further, a liquid surface stabilizer is provided to stabilize the liquid surface and to increase the flotation power. The rotary blade unit is disposed in the surface area of the liquid to reduce the power required for driving the blade unit.

More specifically, the flotator of the invention comprises a funnel-shaped liquid cell; a bubbling device including an upper sleeve opened at its upper end to the atmosphere and immersed at its lower end in a liquid contained by the cell, a lower sleeve disposed coaxially with the upper sleeve and completely immersed in the liquid, the upper end of the lower sleeve being spaced by a predetermined distance from the lower end of the upper sleeve to form therebetween a spaced region which is located at a small depth from the surface of the liquid, and a rotary blade unit having upper and lower blades separated by a flat partition plate and adapted to rotate around the common axis of the upper and lower sleeves, the rotary blade unit having a thickness or axial height substantially equal to the predetermined distance of the spaced region and disposed such that the flat partition plate is located substantially at the heightwise mid point of the spaced region; a liquid surface stabilizer including at least one frusto-conical member with or without perforation and accommodating a multiplicity of baffle plates which act against rotation of the liquid, the frusto-conical member being disposed so as to surround the bubbling device coaxially with the latter; a feeding passage having a feed gate opened in the region near the bottom of the liquid cell and a discharging passage having a discharge gate spaced from the feed gate and also from the lower end of the stabilizer.

The above and other objects, as well as advantageous features of the invention will become more clear from the following description of the preferred embodiments taken in conjunction with the accompanying drawings.

DESCRIPTION OF THE PREFERRED EMBODIMENT

Before turning to the description of the preferred embodiment of the invention, a description will be made first as to the conventional flotators to clarify the disadvantages of the prior arts and, hence, to clarify the technical subject to be solved by the invention.

Figure 1:
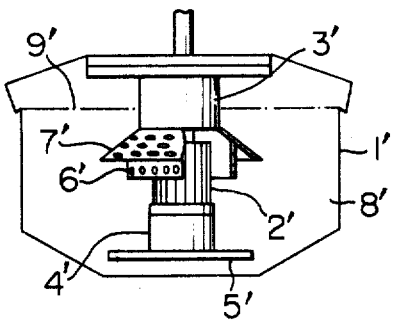
FIG. 1 PRIOR ART
FIG. 1 is a vertical sectional view of a WEMCO 1+1 type flotator which is known per se.

Referring first to FIG. 1 showing a WEMCO 1+1 type flotator, a rotor 2' for generating bubbles is disposed substantially at the center of a cell 1'containing a liquid having a surface 9'. A coaxially aligned communication sleeve 4' is disposed beneath the rotor 2'. Also, a bottom plate 5' is disposed beneath the communication sleeve 4'. In operation, air is induced through a ventilation sleeve 3' and is stirred with the liquid in cell 1' by the rotor 2' forming bubbles which are then released and dispersed in the form of fine bubbles into the liquid through a disperser 6'. The settled particles are wholly sucked through the communication sleeve 4'. These particles, however, are scattered into a considerably large space 8' formed in the cell 1'.

In addition, the aforementioned "short-circuiting" of the liquid takes place to permit a part of the liquid to flow directly from the feed gate to the discharge gate.

Figure 2:
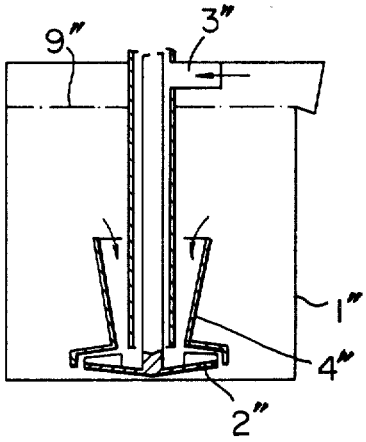
FIG. 2 PRIOR ART
FIG. 2 is a vertical sectional view of a DENVER D-R type flotator which is also known per se.

FIG. 2 shows another conventional flotator called DENVER D-R type flotator. This flotator has a rotor 2'' disposed near the bottom of a cell 1'' and adapted to be drive through a drive shaft which is suspended substantially at the center of the cell 1''. The rotor 2'' is surrounded by an auxiliary funnel 4'' which in turn is held by a sleeve surrounding the drive shaft. A liquid is disposed in cell 1'', with the liquid having a surface 9''. In operation, air is induced through a ventilation port 3'' and is stirred with the liquid in cell 1''. The liquid in the bottom part of the cell is stirred by the rotor 2'' so that mine particles present in the liquid are not allowed to settle nor sediment but collected in the auxiliary funnel 4" so as to be recirculated to the flotation region. The sucking force of the auxiliary funnel 4", however cannot cover the whole area in the cells, so that the effect of recirculation to the flotation region is not so remarkable. In addition, the aforementioned "short-circuiting" of the liquid is inevitable also in this type of flotator. Further this type of flotator necessitates a blower for supplying air to ventil.

The above-described drawbacks or shortcomings of the prior art are obviated in the flotator of the present invention, as will be understood from the following description of the preferred embodiment.

Figure 3:
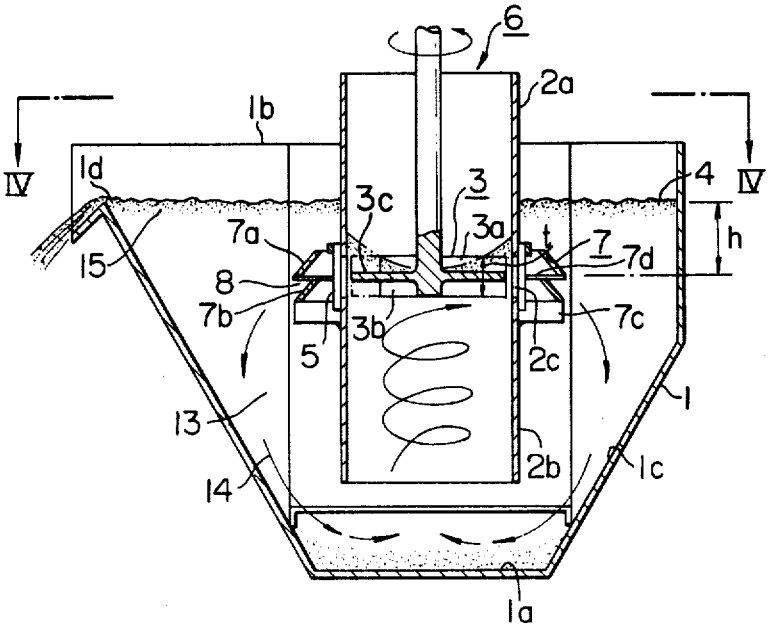
FIG. 3 is a vertical sectional view of a flotator constructed in accordance with an embodiment of the invention, taken along the line III—III of FIG. 4.

Referring to FIG. 3, there is shown in section a flotator constructed in accordance with an embodiment of the present invention. The flotator has a funnel-shaped cell 1 having inclined walls 1*c* interconnecting the bottom 1*a* of the cell to the upper end 1*b* of the same having a larger area than the bottom. In the illustrated embodiment, the funnel-shaped cell 1 has a polygonal horizontal section. An upper sleeve 2*a* and a lower sleeve 2*b* are coaxially disposed in the cell. The common axis of these sleeves is a vertical line which intersects the cells bottom 1*a* substantially at the center thereof. The upper and lower sleeves 2*a*, 2*b* are supported by respective supporting arms (not shown) extended radially inwardly from the wall 1*c* of the cell 1, such that the upper end of the lower sleeve 2*b* is spaced from the lower end of the upper sleeve 2*a* by a predetermined distance. This distance is selected to be substantially equal to the axial height or thickness (t) of a rotary blade unit 3 which is mounted coaxially with the sleeves and adapted to be driven by a motor (not shown). As will be described later, the rotary blade unit 3 has upper and lower blades 3*a*, 3*b* between which is provided a flat partition plate 3*c*. Upper and lower sleeves 2*a* and 2*b* are at least partially immersed in a liquid contained within cell 1, with the spaced region 2*c* between the upper and lower sleeves 2*a*, 2*b* positioned at a comparatively small depth beneath liquid surface 4, i.e. in the surface region of the liquid.

The rotary blade unit 3 is so positioned that the flat partition plate 3*c* is located substantially at the heightwise mid point of the spaced region 2*c*. Thus, the distance h of the upper face of the partition plate 3*c* from the liquid surface 4 is small. In other words, the partition plate 3*c* is located at a shallow position.

A plurality of upper blades 3*a* (six blades in the illustrated embodiment) are provided on the upper face of the flat partition plate 3*c*, whereas a plurality of lower blades 3*b* (usually the number of lower blades correspond to that of upper blades) are attached to the lower face of the same partition plate 3*c*. The numbers of the upper and lower blades may be differentiated, depending on the combination of the ore particles and the liquid, so as to optimize the bubbling, as well as the upward flow of the liquid in the lower sleeve.

The upper sleeve 2*a* is opened at its one end to the atmosphere and immersed in the liquid at its lower end, whereas the lower sleeve 2*b* is fully immersed in the liquid. These sleeves in combination function as a single sleeve, with the spaced region 2*c* preserved therebetween.

A multiplicity of elongated plates 5*b* are disposed around the spaced region 2*c* between the upper and lower sleeves 2*a*, 2*b*, so as to extend toward the lower sleeve at a constant circumferential pitch. If necessary, these elongated plates 5*b* are connected unitarily by an annular member 5*a* so as to form as a whole a disperser 5. This disperser functions to split the liquid which flows at a high velocity radially outwardly from the rotary blade unit 3 due to a centrifugal force, thereby further splitting the bubbles into smaller ones. The upper sleeve, lower sleeve, rotary blade unit and, if necessary, the disperser in combination constitute a bubbling device which is generally designated by reference numeral 6.

At least one frusto-conical member opened at upper and lower sides is disposed to surround the bubbling device 6 so as to oppose to the spaced region 2*c*. In the illustrated embodiment, two such frusto-conical members are used. The lower frusto-conical member 7*b* is connected to and supported by a plurality of elongated supporting plates 7*c* which are welded at their inner ends to the surface of the lower sleeve and extend radially outwardly therefrom. These supporting plates 7*c* also function as baffle boards acting against the rotation of the liquid in cell 1. The upper frusto-conical member 7*a* is supported at its lower end by a plurality of members 7*d* extending upward from the upper end of the lower frusto-conical member 7*b*, with a passage 8 for bubble-containing liquid defined by member 7*a*. The upper and lower frusto-conical members in combination constitute a liquid surface stabilizer 7. If required, the liquid surface stabilizer 7 may be formed of a single frusto-conical member. What is required for the liquid surface stabilizer is to direct downwardly the flow of bubble-containing liquid which is jetted through the passage 8 extending through the spaced region 2*c*. This frusto-conical member may be formed of a perforated plate, if necessary.

In the flotator of the described embodiment, a solution feeding passage 9 for feeding the solution containing the ore particles, i.e. slurry, is formed along the wall of the cell, by means of a thin plate or a pipe. Feeding passage 9 includes an open feed gate 9*a* through which the solution is fed to the area near the bottom of the cell 1. On the other hand, a liquid discharge passage 10 is formed between a wall 10*a* and one of the side walls of the cell, preferably the side wall opposite to that defining the feeding passage 9. On the side wall 1*c*' defining the discharge passage 10, there is disposed a tail dam 11 which is adapted to adjust the liquid level in cell 1 by superposition of a plurality of flat angular members. Alternatively, the liquid level may be adjusted by a vertically movable slide gate. The opening formed at the lowermost portion of the discharge passage 10 constitutes a discharge gate 10*b*. This discharge gate has to be spaced upwardly from the feed gate 9*a* and from the lower end of the liquid surface stabilizer 7. This arrangement is effective in eliminating the undesirable "short-circuiting" of the solution.

Figure 5:
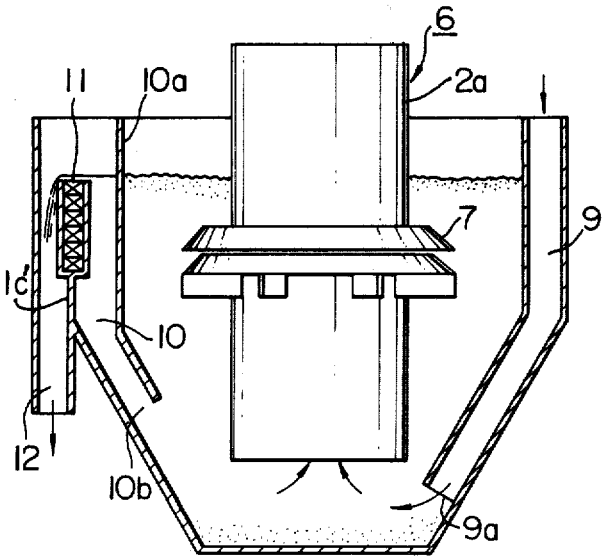
FIG. 5 is a sectional view taken along the line V—V of FIG. 4.
Figure 6:
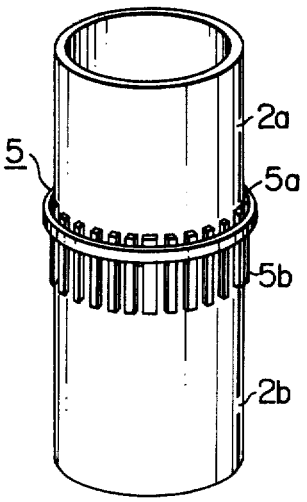
FIG. 6 is a perspective view showing the positional relationship between an upper sleeve, lower sleeve and a disperser incorporated in the flotator shown in FIG. 3.

Referring now to FIG. 5, an outlet 12 is formed to extend in parallel with the tail dam 11.

Figure 4:
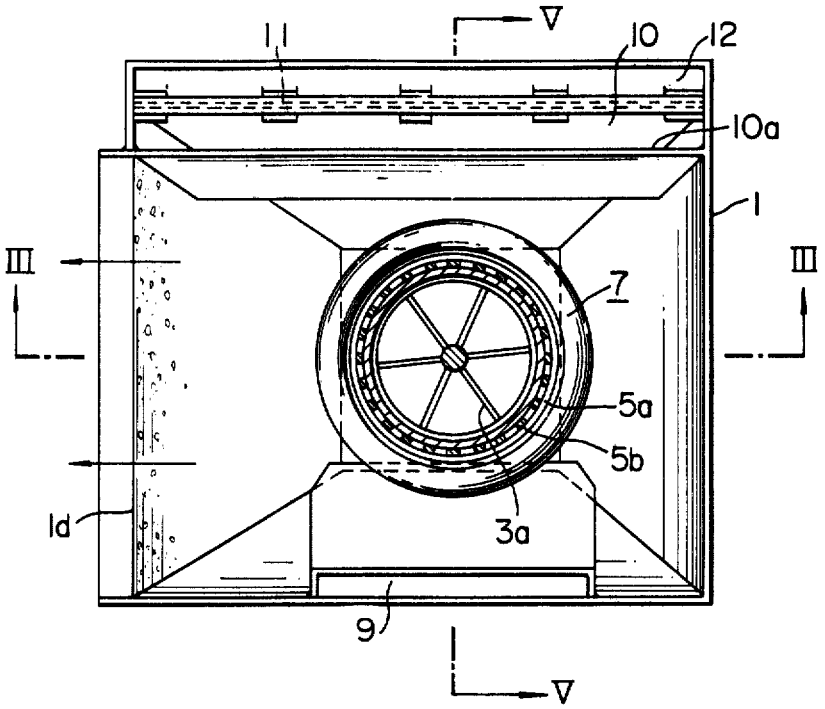
FIG. 4 is a horizontal sectional view taken along the line IV—IV of FIG. 3.

Although the funnel-shaped cell 1 has a polygonal cross-section in the illustrated embodiment, this is not exclusive and the funnel-shaped cell 1 can have circular, oval or any other cross-section. Also, the product discharge opening 1*d* in FIG. 4 may be further extended to the left as viewed in the drawing, or may be provided on two opposing walls of the cell 1. All that is necessary is that the upper edge of the cell can smoothly discharge the product.

Hereinafter, a description will be made as to the operation, function and advantage of the flotator in accordance with the invention.

In the conventional flotator, the mixture of the solution and the bubbles are discharged by the action of the centrifugal force. In this mixture, the bubbles act as buffers against the force imparted by the rotary member to the liquid, so as to hinder the formation of the liquid flow of high velocity, resulting in a wasteful use of the power. If the rotary blade for generating the bubbles is disposed near the bottom of the cell, the bubbling effect is weakened and a considerably large power is required, partly because of the increased head of the liquid and partly because of the density of ore particles in the liquid which is generally high in the cell bottom area.

Upon recognition of these drawbacks of the prior art, according to the invention, the bubbling is made mainly by the upper blades above the flat partition plate of the rotary blade assembly in the area near the liquid surface, whereas the lower blades generate a recycling flow 14 of the liquid containing no or few bubbles. The jet-stream effect caused by this recycling flow effectively induces and extracts the bubble-containing liquid flow from the area of rotation of the upper blades to enhance the bubbles, thereby providing a greater chance of contact between the bubbles and the ore particles contained by the liquid to improve the flotation effect. Thus, the section for bubbling and the section for recycling of newly supplied liquid are separated from each other by means of the flat partition plate 3*c* of the rotary blade unit 3, thereby simultaneously achieving a strengthening of aeration, reduction of power and improvement in the flotation effect.

In addition, the frusto-conical wall of the liquid surface stabilizer acts to direct the bubble-containing liquid downwardly to prevent the disturbance of the product layer 15, thereby stabilizing the liquid surface.

The function and effect peculiar to the constituents of the flotator of invention are summarized hereinbelow.

(1) As the rotary blade unit 3 is rotated, the liquid level of the liquid above the flat partition plate 3*c* is lowered and the liquid is sufficiently mixed with the air by the stirring action of the upper blade to form a bubble-containing liquid rich in air bubbles.

(2) This bubble-containing liquid is discharged by the centrifugal force caused by the rotation of the rotary blade 3 and is split and dispersed by the disperser 5. The bubble-containing liquid then collides with the frusto-conical surface 7*a* of the liquid surface stabilizer 7 and is deflected by the latter to flow downwardly through passage 8 at a high velocity.

(3) As a result of the rotation of the lower blades 3*b* beneath the flat partition plate 3*c* of the rotary blade unit 3, the liquid under the flat partition plate 3*c* and within the lower sleeve 2*b* is forced to flow upward in the form of a spiral flow. This liquid then flows in the form of a jet flow through the spaced region 2*c* and the disperser 5, and is deflected by the inner surface of the frusto-conical wall 7*b* of the liquid surface stabilizer 7, to become a downward flow of a high flowing velocity. Thus, the liquid surface is not disturbed by the recycling flow generated by the lower blades 3*b*. Since the liquid sucked through the bottom opening of the lower sleeve 2*b* contains almost no air bubbles, the liquid flow of high velocity is efficiently formed by the force imparted by the lower blades 3*b*. In other words, the wasteful use of the power attributable to the presence of bubbles is substantially avoided.

In consequence, the jetting of bubble-containing liquid is promoted and enhanced, and the bubbling power of the bubbling device 6 is increased while splitting the air bubbles into smaller ones, thereby enhancing the recycling of the liquid in the cell. Each air bubble just created has a clean surface and exhibits a large surface tension to effectively arrest the floating ore particles.

(4) The product layer (liquid surface layer) 15 is very much stabilized thanks to the use of the liquid surface stabilizer 7.

(5) The side wall or walls of the funnel-shaped cell, which has a smaller bottom area than the upper surface area, naturally guide the settled or sedimented fine particles of ore to the lower end of the lower sleeve 2*b*, so that the particles are effectively sucked through the lower opening of the lower sleeve 2*b* so as to be brought into contact with the air bubbles in the bubble-containing liquid.

(6) A recycling flow of liquid is generated in the cell due to the downward deflection of the liquid flow caused by the liquid surface stabilizer 7. This recycling flow effectively separates the bubbling section and the product layer, resulting in an improved flotation effect.

(7) The feed gate 9*a* is positioned near the bottom of the cell, whereas the discharge gate 10*b* is positioned at the opposite side to the feed gate 9*b* and at a large distance from the latter in the vertical direction. The space between the feed gate 9*a* and the discharge gate 10*b* constitutes a liquid space permitting only a small amount of agitation. As the new solution comes into this space, it moves down to the cell bottom due to its large specific weight, and is sucked together with the recycling liquid into the lower sleeve 2*b*.

Thus, the newly supplied solution cannot directly reach the discharge gate 10*b* detouring the bubbling device 6, i.e. the flotation section, so that the undesirable "short-circuiting" of the liquid, which inevitably takes place in the conventional flotator, is substantially avoided. This greatly contributes to a remarkable improvement in the flotation power of the flotator of the invention.

(8) The flotation takes place at a comparatively small depth from the liquid surface, so that the flotation is not directly affected by the volume of the cell. This means that the size of the cell can be reduced without generating a substantial reduction of the flotation capacity. This offers a great advantage of reduction of installation area and space, particularly when a plurality of flotators are used in parallel or series connection. Also, the cost such as production cost, installation cost, maintenance cost and so forth are remarkably reduced.

Principal data of the flotator of the invention is shown in Table 1 in comparison with those of the conventional flotators WEMCO 1+1 and DENVER D-R, by way of reference.

The flotator of the present invention can be used in coal dressing yards, as well as for ore dressing, wet refining, foul solution treatment and so forth. Table 2 shows the result of a test in which the flotator of the present invention was used together with a DENVER type flotator for a comparison purpose. The flotator of the present invention used in the test had the following principal dimensions:

diameter of rotary blade unit: 900 mm
breadth of cell: 2000 mm length of cell: 3350 mm depth f cell: 1750 mm The ash content of the coal subjected to the coal dressing was about 20%. In the DENVER type flotator, tailing ash content was 28.04%, whereas, in the flotator of the invention, a larger tailing ash content of 36.25% was observed in a treating amount which is about three times as large as that of the DENVER type flotator. This confirms the excellent performance of the flotator device of the present invention.

As to the power consumption, the DENVER type flotator consumed 0.085 $Kw/M^3/h$, while the flotator of the present invention consumed only 0.028 $Kw/m^3/h$ which is about one third of that consumed by the DENVER type flotator. Clearly, the flotator of the present invention has a high efficiency over conventional flotators. This high efficiency is attributable to various features of the invention such as stabilization of the product layer achieved by the liquid surface stabilizer, separation of bubbles effected by the flat partition plate of the rotary blade unit, positional relationship between the feed gate and the discharge gate, small depth of position of the rotary blade unit from the liquid surface and so forth.

TABLE 1

| | Item | Flotator of invention | DENVER D-R | WEMCO 1 + 1 |
|---|---|---|---|---|
| 1 | type of rotor | upper and lower blades with partition plate | saucer-like with upper blades | star-shaped rod-like blade |
| 2 | bubble mixing | liquid surface stirring | liquid surface stirring | liquid surface stirring |
| 3 | extraction of bubble-containing liquid | centrifugal flow with no bubble | centrifugal flow with bubble | centrifugal flow with bubble |
| 4 | ventilation | self sucking | forced feeding | self sucking |
| 5 | prevention of settlement | sucking through communication sleeve | bottom stirring | no special intention |
| 6 | circulation of fluid | all part flows through flotation region | a part flows through flotation region | no circulation through flotation region |
| 7 | position of bubbling section | surface layer | cell bottom | surface layer |
| 8 | feed and discharge gates | bottom and upper positions | free flow | free flow |
| 9 | short-circuiting | no short-circuiting | short-circuiting inevitable | short-circuiting inevitable |
| 10 | relation between cell volume and capacity | no relation | some relation | some relation |
| 11 | liquid surface stabilizer | stabilizer with no perforation used | no stabilizer used | stabilizer with perforation used |
| 12 | flotation region | surface layer | whole part of cell | mainly in deeper surface region |

TABLE 2

| Types | Treating Rate $m^3/M$ | Peripheral speed m/sec | Quality, ash content Feed | Product | Discharge | Number of test | Power consumption kw | Power consumption per unit amount of treated liquid $kw/m^3/h$ |
|---|---|---|---|---|---|---|---|---|
| Testing machine of invention | 279 | 8 | 23.50 | 10.44 | 36.25 | 6 | 7.9 | 0.028 |
| * DENVER | 88 | — | 19.53 | 11.53 | 28.04 | — | 7.5 | 0.085 |

It was confirmed also that a simplified form of the flotator of the invention having no liquid surface stabilizer can effectively be used as an aerator.

From the foregoing description, it will be understood that the present invention offers various advantages such as enhancement of the bubbling power, increase of the flotation capacity, reduction of the machine size, decrease of rate of power consumption and so forth.

What is claimed is:

1. An improved flotator assembly for generating bubbles in a cell containing a quantity of liquid, and comprising:

separate, substantially coaxially disposed hollow sleeve members including an upper sleeve member partially immersed in a liquid contained within said cell, and further including a lower sleeve member totally surrounded by said liquid, said upper and lower sleeves including open, interior portions spaced from one another a predetermined distance, thereby defining a spaced region between said sleeves which is located more closely to the surface of said liquid than to a bottom surface of said cell;

rotatable upper blade means located within said spaced region and having an area of rotation confronting the open, interior portion of said upper sleeve for generating a substantially bubble-rich flow of liquid within the immediate area of rotation of said upper blade means;

rotatable lower blade means located within said spaced region and having an area of rotation confronting the open, interior portion of said lower sleeve for recycling a high velocity flow of liquid between the interior portion of said lower sleeve and a remaining portion of said liquid-filled cell, wherein said high velocity flow is substantially devoid of bubbles;

partition means located between said upper and lower blade means and substantially spanning said spaced region for preventing said bubble-rich flow of liquid from mixing with said high velocity flow within said spaced region; and frusto-conical stabilizer means surrounding said spaced region for directing said high velocity flow toward the bottom surface of said cell, thereby generating a jet stream effect which effectively draws the bubble-rich liquid flow from the area of rotation of said upper blade means and into contact with said high velocity flow during passage through the remaining portion of said liquid-filled cell, significantly increasing the chance of contact between said bubbles and any solid particles contained within said high velocity flow.

2. An improved flotator assembly according to claim 1, wherein dispenser means are attached to at least one of said hollow sleeves surrounded said spaced region for splitting and dispersing bubbles flowing outwardly from said spaced region.

3. An improved flotator assembly according to claim 2, wherein said dispenser means comprises a plurality of separate, elongated plates disposed about a periphery of at least one of said sleeve members and extending into close proximity to a periphery of the sleeve, thereby forming a plurality of slits leading from said spaced region into a remaining portion of said cell.

4. An improved flotator assembly according to claim 1, wherein said cell has a substantially funnel-shaped configuration and includes both a feed gate and discharge gate for transporting feed particles into and out of the liquid contained within said cell, wherein said discharge gate is spaced from said bottom surface of said cell a greater distance than said feed gate to inhibit direct flow of said feed particles between said feed gate and discharge gate, respectively.

5. An improved flotator assembly according to claim 1, wherein said upper and lower blade means each comprises a plurality of blade members mounted on upper and lower surfaces of said partition means, respectively.

6. An improved flotator assembly according to claim 5, wherein said partition means comprises a substantially flat plate member positioned at a substantial mid point between said upper and lower hollow sleeve members.

7. An improved flotator assembly according to claim 5, wherein a rotatable drive shaft extends through at least one of said hollow sleeve members into attachment with said substantially flat plate member providing joint rotation of said drive shaft and plate member.

8. An improved flotator assembly according to claim 1, wherein said frusto-conical stabilizer means comprises separate upper and lower frusto-conical members, wherein said lower frusto-conical member is attached to said lower sleeve via a plurality of elongated supporting plates and said upper frusto-conical member is attached to said lower frusto-conical member via a plurality of spaced attachment members extending therebetween.

9. An improved flotator assembly according to claim 8, wherein said upper frusto-conical member includes a plurality of perforations extending completely therethrough.

* * * * *